United States Patent [19]

von Wedel

[11] Patent Number: 4,470,704

[45] Date of Patent: Sep. 11, 1984

[54] PROCESS AND APPLIANCE FOR MIXING MATERIALS IN BULK

[75] Inventor: Karl von Wedel, Hamburg, Fed. Rep. of Germany

[73] Assignee: Claudius Peters Industrieanlagen GmbH, Hamburg, Fed. Rep. of Germany

[21] Appl. No.: 340,967

[22] Filed: Jan. 20, 1982

[30] Foreign Application Priority Data

Jan. 24, 1981 [DE] Fed. Rep. of Germany ..... 3102270

[51] Int. Cl.[3] ..... B01F 13/02

[52] U.S. Cl. ..... 366/106; 222/195; 222/637; 406/90; 366/107

[58] Field of Search ..... 366/101, 106, 107, 192, 366/193, 341; 222/195, 637; 406/90, 138; 99/646 S

[56] References Cited

U.S. PATENT DOCUMENTS 2,613,854 10/1952 Sylvest et al. ..... 222/195 X 4,364,665 12/1982 Ahrens et al. ..... 222/195 X

FOREIGN PATENT DOCUMENTS 2844589 4/1980 Fed. Rep. of Germany ..... 366/341

*Primary Examiner*—Stephen Marcus

*Assistant Examiner*—Joseph M. Pitko

*Attorney, Agent, or Firm*—Prutzman, Kalb, Chilton & Alix

[57] ABSTRACT

A process for mixing materials in bulk comprises the continuous and simultaneous withdrawal, through discharge openings distributed about the periphery of a mixing silo, of the material in such a manner that the vertical velocity of the descending material increases progressively about the periphery of the silo. Apparatus in accordance with the invention comprises a mixing silo having a relatively large number of discharge openings and means for insuring that the velocity differences in the material being withdrawn through adjacent openings is relatively small whereby the variation in material vertical velocity from the lowest to the miximum value will occur over a large number of discharge openings.

11 Claims, 7 Drawing Figures

PROCESS AND APPLIANCE FOR MIXING MATERIALS IN BULK

BACKGROUND OF THE INVENTION (1) Field of the Invention

The invention relates to a process for mixing materials in bulk during passage through a mixing silo, a plurality of discharge openings being provided, spaced apart from each other, in the floor region of the silo, the material being withdrawn from these openings in a differentially controlled manner, so that different descent velocities are established, zone by zone, in the material contained in the silo. The invention further relates to a mixing silo for carrying out this process.

(2) Description of the Prior Art

In a known process of this type (Periodical: Aufbereitungstechnik, 1977, Page 566, FIG. 3), the silo floor is provided with aerating devices, and is inclined towards the centre, while a discharge chamber is provided in the centre of the floor, a large number of openings being distributed in the wall of this chamber, through which openings the material is withdrawn from the silo.

The eccentric arrangement of the discharge openings causes the material stored in the silo to form a plurality of eccentric discharge vortices. The term "vortex" is to be understood as that region in the bulk material, above a discharge opening, which moves downwards, during the withdrawal of material, more quickly than the surrounding material.

In the case of another silo, which is not specifically designated as a mixing silo, it is additionally known (from German Offenlegungsschrift No. 2,336,984) that the silo floor, which is provided with aerating devices, can be allowed to run with an inclination in the outward direction to a large number of peripherally located discharge openings which emerge into an annular passage located within the silo wall, under a slope which encircles the silo floor. Air can be admitted to the aerating devices on the silo floor, which are assigned to the individual discharge openings, at regular intervals and in different amounts.

SUMMARY OF THE INVENTION

The object underlying the invention is to improve the mixing action during a mixing process of the type initially mentioned. This object is achieved, according to the invention, in that the material is withdrawn, essentially continuously and simultaneously, through discharge openings which are distributed around the periphery of the silo compartment, the velocity difference increasing to its maximum value over a large number of discharge openings, mutually adjacent openings possessing, in each case, only small velocity differences.

While, in the state of the art, the aim was to obtain large differences in withdrawal velocity between adjacent discharge openings, in order to obtain, by this means, large differences in the descent velocities over small horizontal distances within the material stored in the silo, the invention is founded on the discovery that it is more advantageous to obtain the differences in the descent velocities, these differences being responsible for the mixing, over the greatest possible horizontal distances, the velocity differences in closely adjacent zones being comparatively small. The lower relative velocities lead to a lowering of the frictional losses and thereby to a reduction in the expenditure of energy.

Moreover, larger volumes within the silo compartment become involved in the continuous withdrawal movement, so that those volumes in which the material remains more or less motionless for long periods, and consequently does not participate in the mixing movement, are reduced in size. Admittedly, a more or less inactive cone of material forms in the centre of the silo floor, but this cone has a comparatively small volume and promotes the outward deflection of the vertical material-flows towards the discharge openings. A further important advantage of discharging the material peripherally resides in the fact that the burden imposed by the material present in the silo impairs this peripheral discharge less markedly than a central discharge. This is due to the fact that a considerable portion of the weight of the material which is descending in the peripheral space within the silo is taken up by friction created by the silo walls. When the discharge openings are arranged peripherally, a lower air pressure is accordingly required at the floor, in order to loosen the material which is to be withdrawn.

In a mixing silo, according to the invention, for carrying out the process, arrangements are made to locate the discharge openings at the outer periphery of the floor, and for them to open into an annular passage, which is designed for conveying the material to a point at which it is collected or transferred.

Since, with regard to the energy requirement for withdrawing the material, and for the reasons explained, it can be expedient to locate the discharge openings as near the periphery as possible, it is arranged, according to a further feature of the invention, to locate the annular passage outside the silo wall. However, it is also possible, in many cases, to locate the annular passage inside the silo wall.

For conveying the material, pneumatic conveyor troughs can be provided in the annular passage, the latter being inclined in the conveying direction.

A particularly small space requirement for the conveying devices is obtained when the discharge openings through the silo wall are pipes which can be shut off, and when the annular passage is designed as a pneumatically conveying ring main. According to a further feature of the invention, the pneumatically conveying ring main can merge into a pneumatic lifting tube. This arrangement is particularly expedient, since, in many cases, a vertical pneumatic conveying device, known under the name "Airlift", must be connected downstream of a silo. In the case of the invention, this device can be connected directly to the ring main, or to the discharge openings.

The different discharge rates around the periphery can be obtained in different ways. For example, the discharge openings can have different diameters, which are graded around the periphery of the silo. It is even possible to provide, at the discharge openings, means for altering the discharge velocity. Finally, the invention is also intended to include the possibility that, while the discharge openings are essentially identical, their peripheral spacings are different.

In each case, the desired alteration in the discharge velocity, and thereby in the descent velocity of the material around the periphery of the silo, is achieved. In doing so, it is possible to arrange for the alteration in the discharge velocity to be accomplished in the same direction around the entire periphery. In this case, an abrupt change occurs at one point on the periphery, from the maximum discharge velocity to the minimum discharge velocity. At this point, it is possible for the discharge openings, to which the maximum and minimum discharge velocities are respectively assigned, to be separated from each other by a fixed radial wall, which prevents the material from flowing over from the region in which the descent velocity is lower into the region which is descending more rapidly, or which allows only a little material to flow over. Instead of a descent-velocity profile of a type which extends over the entire periphery of the silo, it is also possible to choose a profile of the type which extends only over one diameter, in which the points of maximum and minimum discharge velocity are, in fact, located at opposite points of the periphery, while the discharge openings lying on either side of this diameter are adjusted to a progressive variation in the discharge velocity. In this case also, the desired descent-velocity profile, occupying a large volume, is obtained.

To ensure that the material is conveyed in the discharge openings, they can be equipped with devices for cyclically conveying slugs of material. This device expediently comprises two or more aerating elements, which are located at different distances from the discharge opening and to which compressed air can be admitted in a cyclically alternating manner. In this arrangement, the change from one aerating element to the other can be effected automatically, by means of a self-switching two-way valve.

In addition to the advantages relating to the mixing function and to better utilization of the silo space, the externally-located arrangement of the discharge openings, according to the invention, possesses the advantage that these openings can easily be inspected and serviced from the outside. The annular passages can be large enough to admit a man.

The mixing process according to the invention enables long-term fluctuations in composition to be rendered less pronounced, with a comparatively small silo volume. If, in addition to this, small-scale homogenization is desired, a continuous-flow mixer can be connected downstream. For example, a continuous-flow mixer having a capacity of 5–50 t can be connected downstream of a 10,000-t silo.

BRIEF DESCRIPTION OF THE DRAWING

In the text which follows, the invention is explained in more detail, by reference to the drawing, in which.

DESCRIPTION OF THE PREFERRED EMBODIMENTS

Figure 1:
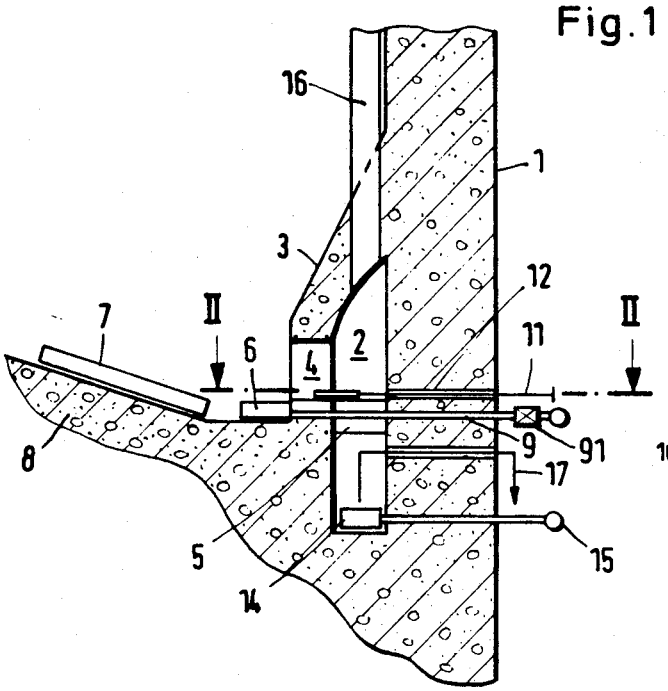
FIG. 1 shows a vertical partial section through a silo, in the silo wall/silo floor corner region, .
Figure 2:
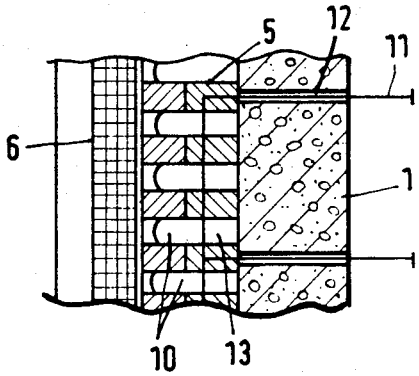
FIG. 2 shows a section along the line II—II in FIG. 1.

In the first illustrative embodiment (FIGS. 1 to 3), an annular passage 2 is partitioned off on a concrete silo wall 1, on the inside, by a concrete facing piece 3. The facing piece 3 is interrupted by holes 4, which in total area correspond to a peripheral opening of approximately 50%. In addition, the facing piece 3 is supported against the radial pressure of the material, by concrete masonry 5, which is interrupted to the extent of approximately 50%. Aerating elements 6 are located, on a ledge on the facing piece 3, over the entire periphery of the silo. If desired, additional aerating elements 7 may be located on the silo floor 8. The gas employed for loosening the material is supplied to the aerating elements 6, 7 via pipes 9, which can be shut-off by valves 91, these pipes being located in the silo wall 1, spaced 1–10 m apart at the periphery. A slide-valve 10 is operated by means of a rod mechanism 11 which passes through sleeves 12 in the silo wall 1, these sleeves being spaced 1–5 m apart and releasing the material to the different discharge openings 13 in the annular passage 2. The annular passage 2 is inclined at the periphery by 5°–10° (not represented in the drawing), and is designed with pneumatic conveyor troughs 14, which are supplied via a ring line 15. The gas used for loosening and conveying the material present in the silo is used in the conventional manner, the loosening gas being extracted from the silo and the conveying gas being extracted from the annular passage 2, via a collecting main 16. A slightly sub-atmospheric pressure is established in the annular passage 2, in order to protect the seals in all the tube-sleeves in the silo wall 1.

Figure 3:
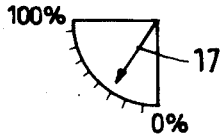
FIG. 3 shows an adjustment-indication for graded discharge velocities.

Swinging feelers 17 are located, by means of additional sleeves, in the annular passage 2, in order to display, externally, both the level to which the passage is filled with material and the conveying rate, or in order to pick off these parameters electrically, by means of a potentiometer (see FIG. 3).

Using the loosening gas from the aerating elements 6 and the slide-valves 10, as indicated by the swinging feelers 17, smoothly graded withdrawal rates are set, for which purpose it is possible to provide appropriate control devices.

Figure 4:
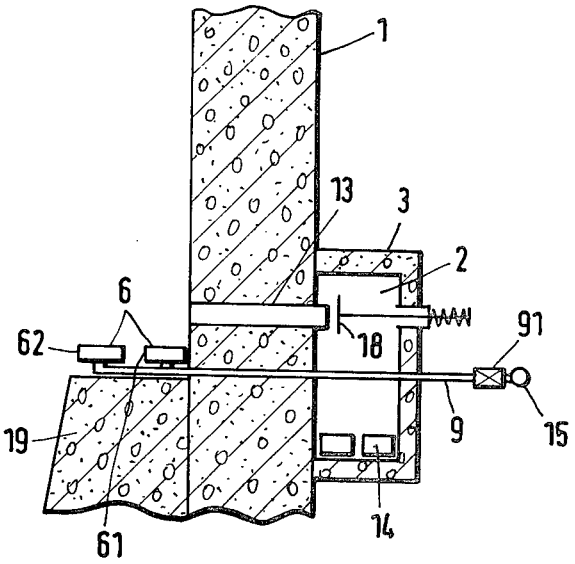
FIG. 4 shows a modified embodiment, likewise in vertical partial section, corresponding to FIG. 1.

In the example of FIG. 4, the annular passage 2 is located on the silo wall 1, on the outside. The discharge openings 13 extend through the silo wall 1, spaced 1–5 m apart at the periphery, are in the form of steel tubes with diameters of 20–200 mm, which can be replaced in the event of wear. The discharge openings 13 can deviate from the radial direction, for constructional reasons. The aerating elements 6 are located in the silo, in front of the discharge openings 13, the loosening gas being supplied to these elements from the ring line 15, via the pipes 9, which can be shut off and are spaced 1–10 m apart. It is possible to admit gas to the aerating elements, through additional valves, which are not shown in more detail here, for an inner aeration 61, or an outer aeration 62, according to choice, or for both aerations simultaneously, so that the loosening gas entrains a greater or lesser quantity of material as it escapes to the tubes 13. The loosening gas is released via the valves 91. Two or more tubes 13 are assigned to each valve 91. The valves 91 are successively actuated by the control system, so that the material to be conveyed and the loosening gas must necessarily escape via one of the associated tubes 13, provided that care is taken to maintain a sufficient gas pressure and a sufficient filling level inside the silo.

An additional influence on the discharge rate is effected by means of a spring-loaded retarding disc device 18, which throttles the rate at which material is conveyed through the tube and provides an external indication by means of the spring movement.

The aerating elements 6 are located on a concrete ledge 19, the height of this ledge above the silo floor 8 being determined by the inclination of the annular passage 2.

Figure 5:
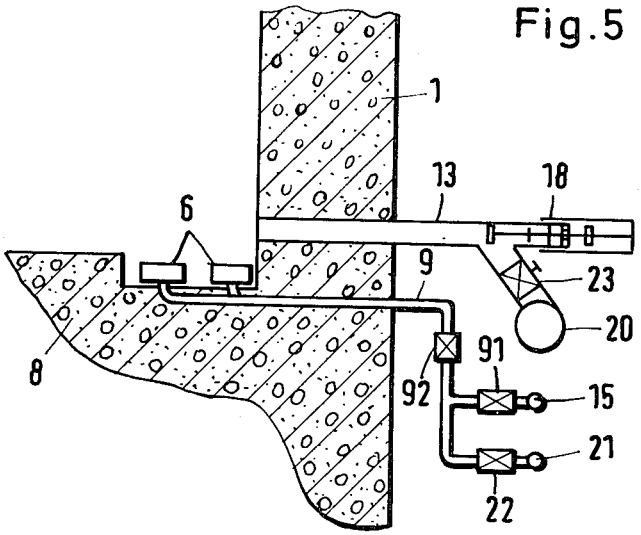
FIG. 5 shows a further embodiment, likewise in vertical partial section, corresponding to FIGS. 1 and 4.
Figure 6:
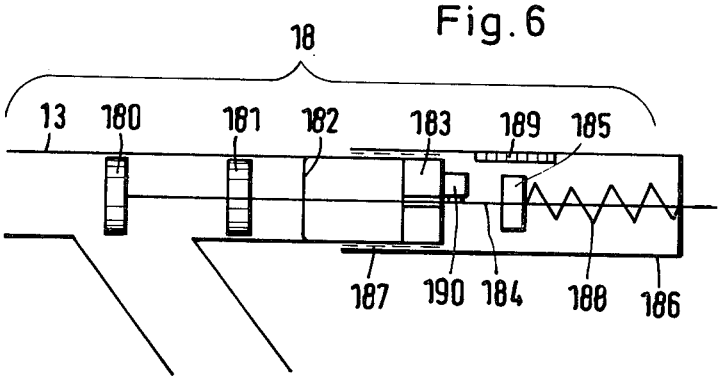
FIG. 6 shows a retarding disc device, for use in the embodiments shown in FIGS. 4 and 5, and, FIG. 7 shows an arrangement for one setting of the withdrawal-velocity profile over the periphery of the silo.
Figure 7:
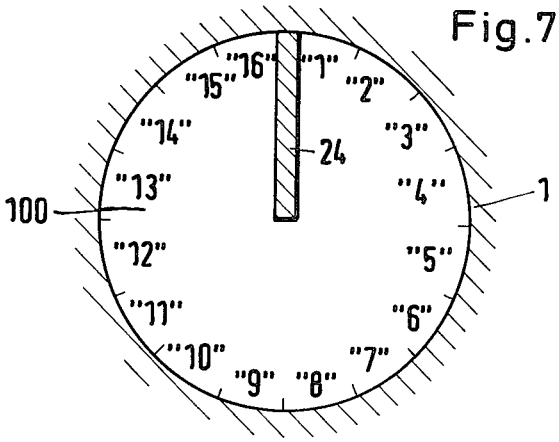

FIGS. 5–7 show another illustrative embodiment, in which the discharge openings 13 in the silo wall 1 are in the form of steel withdrawal tubes having diameters of 20–200 mm. The aerating elements 6 are inserted into the silo floor 8, it being possible to admit gas to the inner elements, or to the outer elements, according to choice, as in the example of FIG. 4.

The loosening gas from the ring line 15 is released via the valve 91 and escapes, with the material, into a conveying ring main 20, via the discharge openings 13. A separately controlled aerating element 6 is assigned to each discharge opening 13. All aerating elements 6 and discharge tubes 13 are operated simultaneously, in parallel with the ring line 15 and the conveying ring main 20, respectively. The diameter of the conveying ring main 20 is graded to correspond to the quantity of material being conveyed, which increases around the periphery. In addition, this main can be connected directly to a source of conveying gas.

The withdrawal velocities are graded around the periphery of the silo and are permanently set, for each discharge tube 13, using manual throttle-valves 92 and the retarding disc device 18.

If a tube 13 becomes blocked, or its feed region becomes blocked, a contact comes from the retarding disc device 18. This contact switches the aeration 6, for a predetermined period, from the parallel ring line 15 to the direct line 21, this switching being accomplished by a valve 22, which is closed during normal operation. In the direct line 21, the loosening gas is compressed, or kept available, at a pressure which is 0–1 bar higher than the pressure in the parallel ring line 15.

A fault indication occurs if the blocked line does not become clear, or if the contact of the retarding disc device 18 does not switch. In this event, the line can be cleared by hand. For this purpose, a repair-valve 23, and the valves 91 and 22 are closed, and the retarding disc device 18 is unscrewed.

The retarding disc device 18 comprises a retarding and deflecting disc 180, a guide disc 181, a sealing disc 182, a closure cap 183, a connecting rod 184, possessing a threaded portion and a loading nut 185, and a spring-cage 186, possessing a threaded adjuster 187, a spring 188, a spring-force indicator 189, and the contact 190.

In a silo 100, in which the discharge velocities at the periphery are graded from "1"–"16", a partition 24 is located between the velocities "1" and "16" (FIG. 7).

In the process according to the invention, the material is withdrawn through all the discharge openings, continuously and simultaneously, in so far as this withdrawal gives rise to an essentially constant descending movement in the silo compartment, even if this movement is differential in nature. However, this constant movement should not exclude a periodic mode of operation at the individual discharge openings, of a type in which the openings are briefly opened and are then closed again, in such a way that the constancy of the descent velocity is not thereby influenced in practical terms. This mode of operation must be regarded in contrast to those known processes, in which individual discharge openings are opened for several minutes' duration, while others are closed, in order thereby to give rise to a regionally non-uniform descending movement in the silo compartment.

I claim:

1. In a process for mixing materials in bulk, the materials being delivered to a mixing silo having a mixing compartment with a plurality of discharge openings spaced about the periphery of the compartment adjacent the bottom thereof, the materials subsequently being withdrawn from the silo compartment through the discharge openings, the improvement wherein the withdrawing step of the bulk mixing process comprises providing means for incrementally varying the discharge openings so as to establish material descent velocities within the silo compartment which vary incrementally and serially about the periphery of the silo compartment from a minimum to a maximum value and generally continuously and simultaneously withdrawing the materials from each of the incrementally varied discharge openings to provide corresponding successive, relatively small incremental variations in the material descent velocities within the silo compartment and a total relatively large material descent velocity variation within the silo compartment.

2. A bulk mixing process according to claim 1 wherein the mixing materials are withdrawn from the plurality of discharge openings into a generally annular material conductor extending peripherally around the silo compartment and further comprising the step of conveying the mixing materials within the generally annular material conductor for collection.

3. The bulk mixing process according to claim 2 wherein the generally annular material conductor is provided externally of the silo and the step of withdrawing the materials further includes directing the materials through a mixing silo wall to the generally annular material conductor.

4. A bulk mixing process according to claim 2 or 3 wherein the step of conveying the material within the generally annular material conductor comprises pneumatically conveying the material along an inclined path.

5. A bulk mixing process according to claim 2 wherein the spaced silo discharge openings are defined by conductor pipes and wherein the step of providing means for incrementally varying the discharge openings comprises providing individual discharge control means in each conductor pipe for controlling the rate of material discharge therethrough and wherein the generally annular material conductor is a pneumatic tube and said step of conveying comprises pneumatically transporting the materials.

6. A bulk mixing process according to claim 5 further comprising the step of pneumatically conducting the materials upwardly from the generally annular pneumatic tube for collection.

7. A bulk mixing process according to claim 1, 2, or 3 wherein the step of providing means for incrementally varying the discharge openings comprises spacing the silo discharge openings around the periphery of the silo compartment at different distances from each other.

8. A bulk mixing process according to claim 1, 2 or 3 wherein the step of providing means for incrementally varying the discharge openings comprises providing different size discharge openings.

9. A bulk mixing process accordiing to claim 1, 2, 3, 5 or 6 wherein the succession of discharge openings are arranged all the way around the silo compartment and further comprising the step of providing a generally radial wall within the silo compartment between the first and last discharge openings of said succession of discharge openings and wherein said first and last discharge openings respectively have the lowest and highest rates of withdrawal and materials therefrom.

10. A bulk mixing process according to claim 1, 2, 3, 5 or 6, further comprising the step of cyclically conducting slugs of materials through each of the plurality of discharge openings.

11. A bulk mixing process according to claim 10 wherein the step of cyclically conducting slugs of materials through each of the succession of discharge openings comprises the step, for each such discharge opening, of cyclically and alternately conducting compressed air to the silo compartment adjacent the bottom thereof at different generally radial distances from such discharge opening.

* * * * *